US006098522A

United States Patent [19]

Granberg

[11] Patent Number: 6,098,522

[45] Date of Patent: Aug. 8, 2000

[54] FLUID PRESSURE CYLINDER END WALL DEVICE

[75] Inventor: Rune Granberg, Älvsjö, Sweden

[73] Assignee: AB Rexroth Mecman, Stockholm, Sweden

[21] Appl. No.: 09/182,103

[22] Filed: Oct. 27, 1998

[30] Foreign Application Priority Data

Oct. 29, 1997 [SE] Sweden ..... 9703964

[51] Int. Cl.[7] ..... F01B 29/00

[52] U.S. Cl. ..... 92/88; 92/168

[58] Field of Search ..... 92/88, 165 R, 92/168; 277/907

[56] References Cited

U.S. PATENT DOCUMENTS

| | | | |
|---|---|---|---|
| Re. 34,049 | 9/1992 | Taki et al. | 92/88 |
| 4,373,427 | 2/1983 | Garlapaty et al. | 92/88 |
| 4,555,980 | 12/1985 | Hoglund | 92/88 |
| 4,685,383 | 8/1987 | Ruchser | 92/88 |
| 4,724,744 | 2/1988 | Rosengren | 92/88 |
| 4,852,465 | 8/1989 | Rosengren | 92/88 |
| 4,856,415 | 8/1989 | Noda | 92/88 |
| 4,991,494 | 2/1991 | Migliori . | |
| 5,245,910 | 9/1993 | Drittel | 92/88 |
| 5,473,971 | 12/1995 | Takeuchi et al. | 92/88 |
| 5,606,903 | 3/1997 | Drittel | 92/88 |
| 5,992,295 | 11/1999 | Noda et al. | 92/88 |

FOREIGN PATENT DOCUMENTS

| | | | |
|---|---|---|---|
| 3-4005 | 1/1991 | Japan | 92/88 |

*Primary Examiner*—John E. Ryznic

*Attorney, Agent, or Firm*—Townsend and Townsend and Crew LLP

[57] ABSTRACT

A device in an end wall (3) of a fluid pressure cylinder (1), of the kind including a cylinder tube (2) which is provided with a longitudinal slot through which a transfer element is arranged to transfer movement from a piston being moveable inside the cylinder and which is sealed through at least an inner (8) sealing band, said device being arranged for fastening of the inner sealing band (8) in the cylinder end wall, is distinguished by a fastening unit (4) which is insertable and lockable inside a cavity in the end wall (3) and which is comprised of a profile body (4) having a clamping jaw (5) for holding the inner band (8), said jaw being displaceable by deformation (at 6) and being arranged to co-operate with a first tightening screw (10) for obtaining the displacement.

7 Claims, 2 Drawing Sheets

FLUID PRESSURE CYLINDER END WALL DEVICE

This invention concerns a device according to the preamble of claim 1 and also a fluid pressure cylinder including such a device.

BACKGROUND

From U.S. Pat. No. 4,555,980 such a device is disclosed wherein the fastening unit could be considered to comprise an integral part of the end wall itself, said part comprising threaded holes for co-operation with locking screws for the respective bands and wherein a distance plate is insertable into a cavity in the end wall.

The known device, however, does not fully fulfil the requirements for position accuracy with respect to the bands emanating from the end wall and with respect to simple production, simple assembly and thus totally a competitive cost for the required function.

It is an aim of this invention to develop a device according to the known art so as to obtain safe function at a more competitive cost.

This aim is achieved in a device as above by the feature of the characterizing portion of the claim.

SUMMARY OF THE INVENTION

By the fastening unit, which is insertable into the end wall, consisting of a profile body including an integral clamping jaw which is displaceable by deformation, simple and competitive manufacture is assured as well as mounting, on the one hand of the fastening unit itself, on the other hand at least of the inner sealing band of a corresponding fluid pressure cylinder. Also the fastening function is integrated into one single body omitting the need of further elements to achieve a clamping action and minimizing the number of machining operations on the end wall. Taken together, an advantageous device is obtained with respect to economy and handling. The deformation may be plastic or elastic, depending on choice of material of the profile body, the dimensions and the travel length of the clamping jaw.

The feature of claim 2 brings about simple and appropriate fixing of the fastening unit in the end wall.

The feature of claim 3 result in safe positioning of the fastening unit in the cylinder.

The aspect of the invention according to claim 4 is a preferred aspect of the invention wherein adequate positioning is also obtained for the outer band with respect to its extension along the outside of the cylinder tube, so that unwanted deviations therefrom due to more or less floating counter action is avoided. This is accentuated according to the feature of claim 5, whereby positioning is assured also when, as in smaller cylinders, the tongue must have a more limited section.

The invention also concerns a fluid pressure cylinder including at least one device according to any of the claims 1–6.

The invention will now be described in greater detail with reference to embodiments and the annexed drawings, wherein:

DRAWINGS

FIG. 1 shows a central section through a portion of a fluid pressure cylinder including a device according to the invention, FIG. 2 shows the device in FIG. 1 in a diagrammatic end view, FIG. 3 shows a first alternative embodiment of the invention, and FIG. 4 shows a second alternative embodiment of the invention.

DETAILED DESCRIPTION

Figure 1:
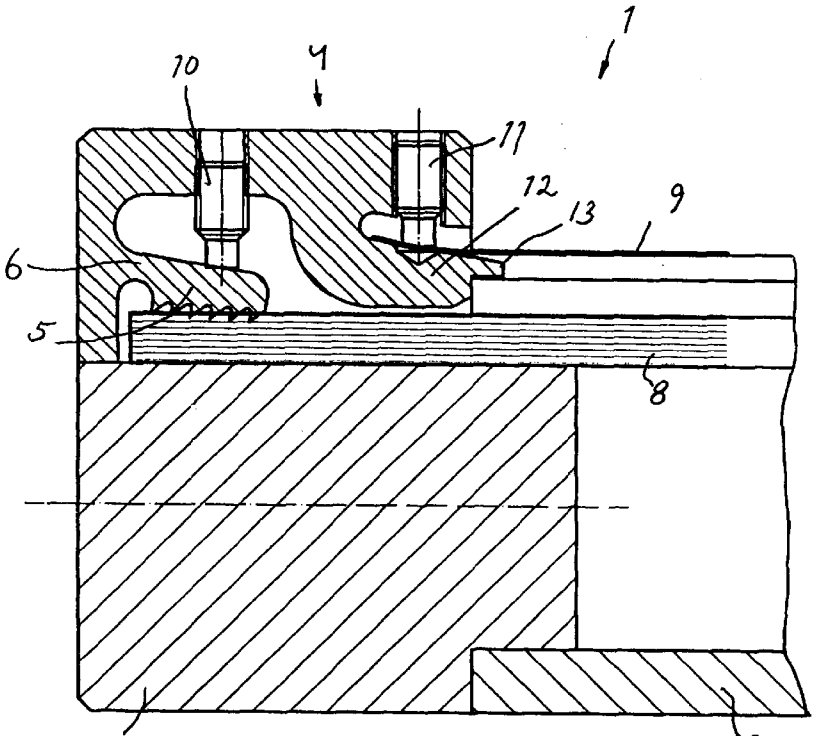

The end portion of the fluid pressure cylinder 1 illustrated in FIG. 1 includes a cylinder tube 2 and a cylinder end wall 3 into which a fastening unit 4 is inserted. The unit 4 consists to the major part (except the screws 10 and 11) of a profile body, having a section which is illustrated in this FIG. 1. Because the fluid pressure cylinder 1 being a rodless cylinder of the slot cylinder type, it includes an inner band 8 for sealing against inner pressure and an outer band 9 for protection against outside influences. The inner band 8 is intended to be fixed in the end wall area by a clamping jaw 5 which comprises a deformable portion 6, so that a limited swinging movement or possibly a displacement movement can be obtained under deformation of this part 6. For tightening the clamping jaw 5 against the inner band 8, the fastening unit 4 is provided with a first tightening screw 10 which is tightened from the outside.

For fixing the outer band 9, there is arranged, on the one hand a second tightening screw 11 and on the other hand a counter-acting tongue 12, and the band 9 is inserted between these elements and tightened by tightening of the screw 11. In order to ensure necessary positioning in the vertical direction, as seen in FIG. 1, and in order, thereby, to avoid inadequate positioning of the outer band with respect to the extension of the slot of the cylinder tube, the tongue 12 comprises a support element 13 in the form of a thin rib, which in use is arranged to co-operate with a surface on the cylinder tube 2 in order to assure that the counter-acting tongue 12 is not swinging aside when tightening the second tightening screw 11.

Figure 2:
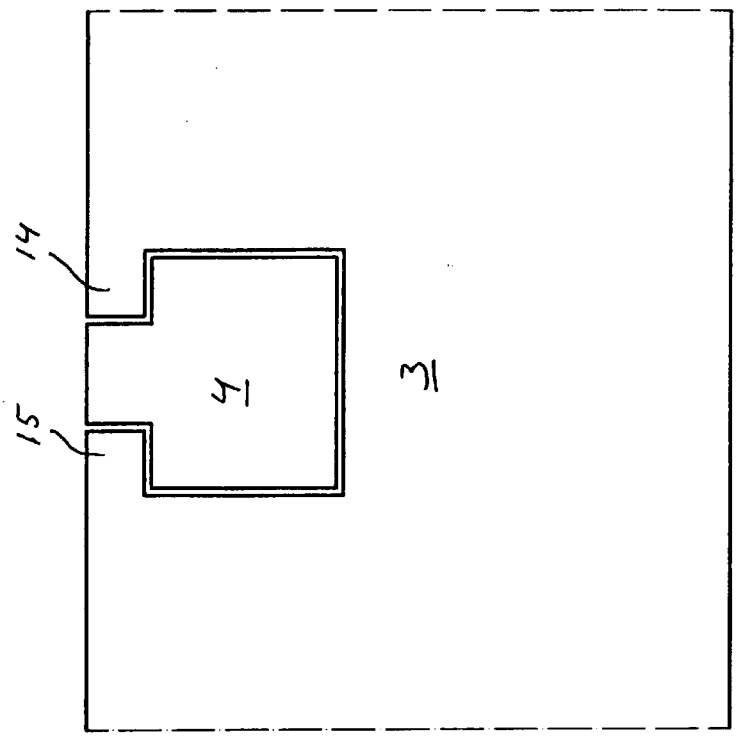

In FIG. 2 which thus is an end view of the device in FIG. 1, the fastening unit 4 is shown inserted into the corresponding cavity in the end wall 3, said cavity being shaped so as to lock, by its shape, the fastening unit in the vertical direction as seen in this Figure. For this purpose the end wall 3 comprises counter-acting portions 14 and 15 projecting inwardly against each other so as to comprise counter-acting elements for corresponding rest portions on the unit 4, transmitting a counter-directed force exerted by the clamping jaw 5 when tightening the first tightening screw 10 and thereby the clamping jaw 5.

Figure 3:
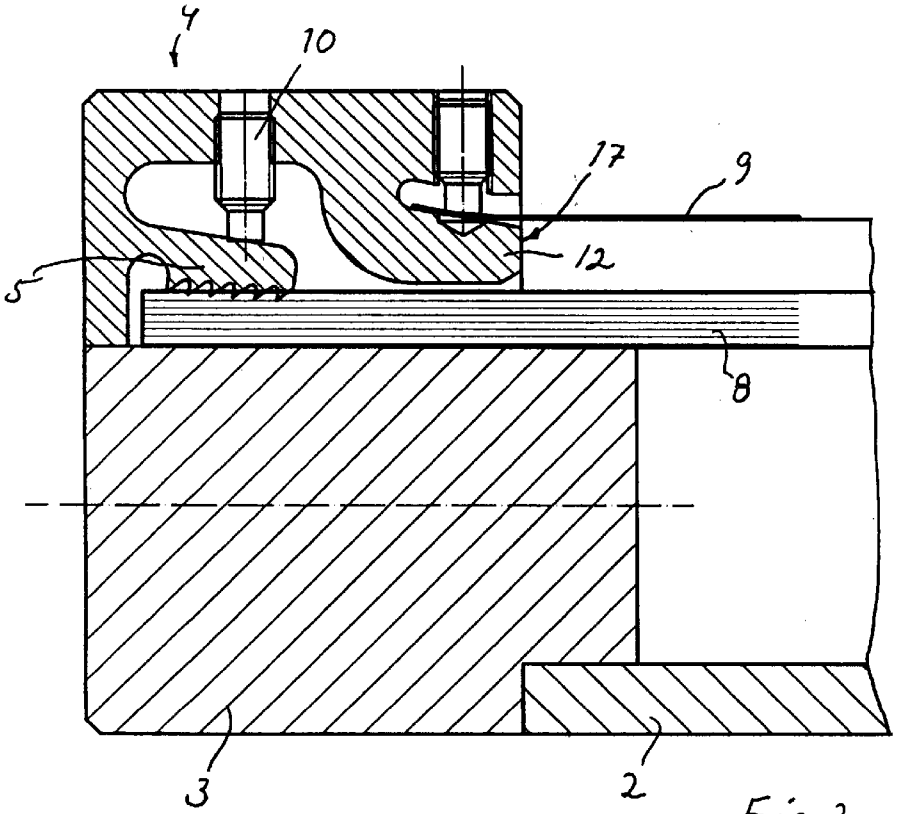

FIG. 3 shows an alternative embodiment of the invention, with the only difference that the counter-acting tongue 12 lacks the support element. In larger dimensions of the counter-acting tongue, a construction according to FIG. 3 is normally sufficient, thus eliminating the need of further support. From FIG. 3 it is, however, more clear at 17 that the unit 4 in function is intended to tightly abut the cylinder tube in order to get the necessary positioning in the axial direction.

Figure 4:
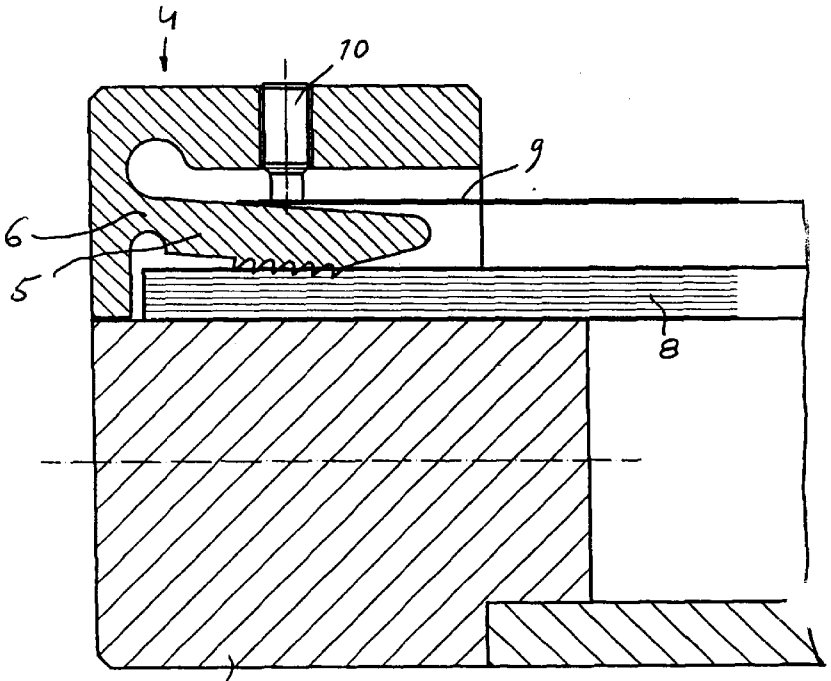

FIG. 4 shows at third embodiment of the invention, wherein the separate tightening screw and the counter-acting tongue for the outer band have been omitted. The fastening function for the outer band is instead obtained by the first tightening screw 10 in combination with the clamping jaw 5. This solution may be satisfactory in such cases where positioning in the vertical direction of the band is less critical.

An advantage of the invention is the possibility of minimizing dirt collecting crevices in the construction. This fact makes the device according to the invention well suited for use in connection with high demands for cleanliness.

It is preferred that the profile body is manufactured from an aluminium alloy in a conventional extrusion process and thereafter simply cut and shaped.

The invention may be modified within the scope of the following claims such that dimensions and shapes of the included parts represented by the different figures may be varied without departure from the invention.

What is claimed is:

1. Device in an end wall (3) of a fluid pressure cylinder (1), of the kind including a cylinder tube (2) having a longitudinal slot through which a transfer element is arranged to transfer movement from a piston being moveable inside the cylinder and which is sealed through at least an inner (8) sealing band, said device being arranged for fastening of the inner sealing band (8) in the cylinder end wall, characterized in a fastening unit (4) which is insertable and lockable inside a cavity in the end wall (3) and which is comprised of a profile body (4) having a clamping jaw (5) for holding the inner band (8), said jaw being displaceable by deformation (at 6) and being arranged to co-operate with a first tightening screw (10) for obtaining the displacement.

2. Device according to claim 1, characterized in that the profile body (4) is shaped complementary to a form locking cavity such that the tightening force from the first tightening screw (10) over the clamping jaw (5) is arranged to fixingly press resting portions on the profile body (4) against counter-acting portions (14,15) of the end wall (3).

3. Device according to claim 1 or 2, characterized in that the profile body (4) is adapted so as to abut (at 17) the cylinder tube (12) in the inserted position.

4. Device according to any of the claims 1–3 in a slot cylinder including also an outer band (9), characterized in that the profile body (4) includes an integral tongue (12) which comprises a counter-acting part for co-operation with a second tightening screw (11) and thereby serves for fastening the outer band.

5. Device according to claim 4, characterized in that the tongue (12) comprises a support element (13) which in use is arranged to rest against a portion of the cylinder tube (2).

6. Device according to any of the claims 1–3 in a slot cylinder including also an outer band (9), characterized in that the vertical dimension of the clamping jaw (5) is adapted such that the outer band (9) is fastenable between the first tightening screw (10) and the clamping jaw (5) in the appropriate radial position.

7. Fluid pressure cylinder including one or two devices according to any of the claims 1–6.

* * * * *